United States Patent [19]

Hines

[11] Patent Number: 5,044,778

[45] Date of Patent: Sep. 3, 1991

[54] LINEAR BARRIER FOR SEPTIC TANKS

[75] Inventor: Alan G. Hines, Exeter, Canada

[73] Assignee: Red Line Products, Seaforth, Canada

[21] Appl. No.: 129,789

[22] Filed: Dec. 7, 1987

[30] Foreign Application Priority Data

Nov. 30, 1987 [CA] Canada ..... 553402

[51] Int. Cl.[5] ..... F16C 29/00

[52] U.S. Cl. ..... 384/7; 16/87 R; 384/26; 384/42

[58] Field of Search ..... 384/7, 20, 26, 36, 41, 384/42; 16/87 R, 87.2, 87.4 R, 95 R, 96 R

[56] References Cited

U.S. PATENT DOCUMENTS 2,024,432 12/1935 Curtis ..... 384/42
2,181,740 11/1939 Reiland ..... 16/87 R
4,557,310 12/1985 Castellaw et al. ..... 16/87.4 R

FOREIGN PATENT DOCUMENTS 48811 11/1988 German Democratic Rep. ... 384/26

*Primary Examiner*—Thomas R. Hannon
*Attorney, Agent, or Firm*—Mitches & Co.

[57] ABSTRACT

Concrete septic tanks have inflow and outflow orifices and near the outflow orifice have screening or baffles which are stapled or bolted to the concrete inner wall so as to force the outflowing liquids to pass a predetermined flow path with the hope to avoid solids passing out of the tank and into a draining tile bed. A novel baffle structure and device for attaching the baffles is disclosed using a linear race with forward and rearward recesses and flexible marginal flap that seals the race onto a core surface of a mold use to fabricate the tank. After the concrete is poured into the mold and partially cured the core is then removed, and the track remains embedded in the concrete and acts as a holding, sealing and anchoring for a baffle, preferably made of a non-corrosive material such as a plastic. The baffle is slipped into the race of the track and seepage across the baffle interface with the tank walls is avoided and the predetermined flow path for the outflowing fluids is ensured. In order to inhibit the outflow of hydrogen and hydrogen dioxide gases, an inclined plate can be placed beneath the outflow channel to deflect entrained gases from flowing up into the outflow channel and outflow orifice and into the draining tile bed.

11 Claims, 7 Drawing Sheets

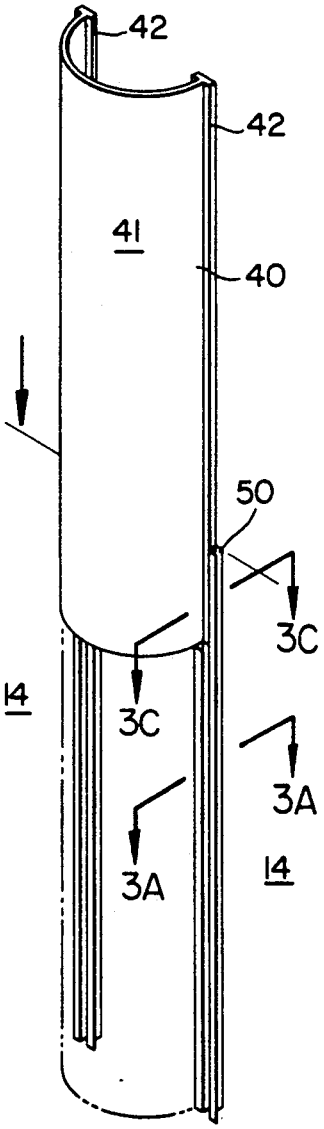
FIG. 2
FIG. 3A
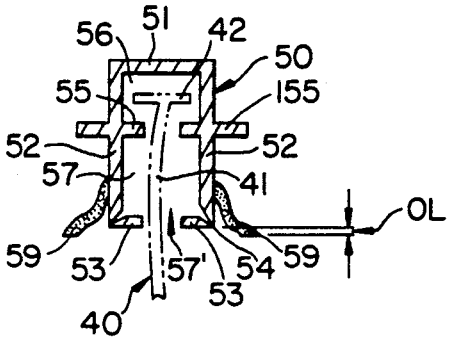
FIG. 3B
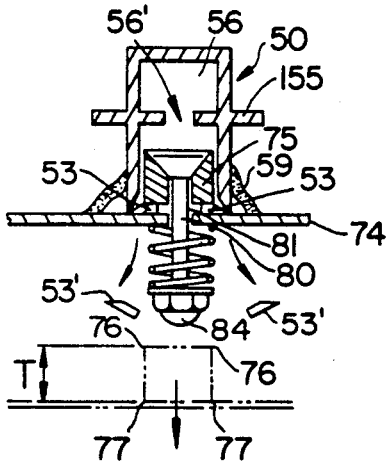
FIG. 3C
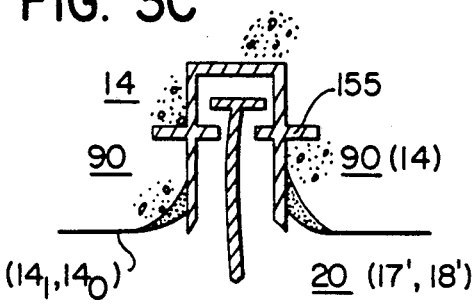

LINEAR BARRIER FOR SEPTIC TANKS

This invention relates to a linear barrier for septic tanks.

In the country side and in some urban areas in North America there are no sewers. As such, human sewerage must be disposed of with the aid of septic tank systems. Septic tank systems include a tank used to hold sewerage wherein it decomposes by known chemical reactions to break down the raw sewerage into a liquid or effluent while there is released Hydrogen gas and Hydrogen Dioxide gas, and solids, most of which precipitate to the bottom, although some remain suspended as suspended solids in the effluent.

The effluent is passed through a screening device to separate the suspended solids out and the effluent then is drawn off into a network of pipes or conduits generally referred to as a "tile bed", that is embedded just below the surface of the ground. The network of pipes and conduits have porous walls that allow the effluent within the conduits to percolate into the ground. In the actual application, some of the effluent evaporates through to the surface.

Such systems of sewerage disposal have been popularized because of the infrequent need for maintenance. Generally, if the tank is large enough, the tank need only be "pumped out" once every ten to twenty years and then only when the precipitated solids have accumulated to such a degree that the free volume in the tank for the breakdown of the raw sewerage therein has been reduced to such a degree as to inhibit proper decomposition of the raw sewerage into its desired processed components of effluents and precipitates.

It is desired that the tank have a separating mechanism to separate out any suspended solid in the effluent, prior to the effluents being drawn off into the tile bed; otherwise, the tile bed will become saturated with the suspended solids which will have accumulated in the tile bed over the years. If this happens the tile bed has to be replaced and this not only is costly but destroys the in situ surface topography since all vegetation such as grass and the like must be removed in order to permit the removal of and the re-installation of a new tile bed.

The invention has specific relevance to the construction of a tank capable of use in such a system. Particularly the invention has application in the simplified fabrication of the separating means for separating the solids suspended from the effluent to permit clear effluent to pass through the tank into the tile bed network.

The prior art employs various separating or screening means as means to divert the flow of the liquids in the septic tank; to encourage bacterial decomposition of the sewerage; and the separation of the resultant solids from the effluent. This is generally achieved by simpliticly placing a screen over the outflow orifice or alternatively communicating with the outflow orifice of the tank to an elevation, within the tank, that is below that of the outflow pipe that communicates with the tile bed thereby requiring the effluent to flow upward within the tank prior to flowing into the outflow orifice. Since this upward flow is very slow, most of the remaining suspended solids tend to coalescence one to another and to precipitate out more easily.

To encourage such flow, the prior art has employed two means as upward flow channelling devices:

(a) the first means is to provide a conduit having an elbow that communicates at one end with the outflow orifice the conduit terminating at a distal orifice located within the tank whereby the distal orifice is located at an elevation below that of the outflow orifice; or, (b) a curved sheet is secured as by stapling along the inner-side surface of the tank whereby the curved sheet forms a passage between it and the inner-side surface that communicates with the outflow orifice. The channel thereby formed has a lower distal inflow end at an elevation that is subjacent to the outflow orifice with which it communicates, and hence, the differential in elevation encourages the flow of the effluent slowly upward in a manner as previously known, to encourage coalescence of solids suspended therein, prior to the effluent flowing out the outflow orifice.

Both of the aforesaid methods suffer certain disadvantages. In the fomer extra material is required to provide a total conduit within the tank and further there is required additional support means to hold conduit reasonably rigid within the tank. In the later, the means of securing the arcuate sheet against the surface is generally either by bolting or stapling. There is thus no liquid tight seal between the juxtapose surfaces of the margins of the curved sheet and inside surface of the tank; flow is allowed to seep through this marginal gap and the efficiency of the preferred flow path is reduced or in severe instances destroyed.

As a by-product during the chemical breakdown of the sewerage into effluent and suspended solids, the suspended solids coalesce and percolate to the bottom of the tank to form a fermenting mass. Over time, sulphuric acid, $H_2SO_4$, is formed; and hydrogen gas, $H_2$, and $SO_2$ are released from this fermenting mass by the "boiling up" of large gas bubbles which frequently pass directly, in prior art units, out of the outflow orifice into the tile bed. Hydrogen gas then percolates out of the tile bed into the surrounding terrain and evaporates into the air.

Entrained with the Hydrogen gas is Sulpher Dioxide which lends the odour of "rotten eggs" and is annoying and discomforting, while Hydrogen gas, when mixed with oxygen can be very explosive, if ignited. These by-products should thus be avoided.

It is an object of the invention to provide a baffle means to ensure that the boiled up gas bubbles, which are rather large, do not pass directly into the outflow orifice. This is achieved by means of a baffle positioned to underlay the outflow orifice and thereby deflect the boiling up gas bubble from direct passage into the outflow orifice. Particularly, this is achieved by the combination of a vertical flow channel associated with the outflow orifice that communicates at its upper extent with the outflow orifice and at its lower extent immediately superadjacent the baffle, thereby requiring the effluent to flow between the baffle and the lower extremity of this channel prior to the effluent flowing into the outflow orifice. This is an effective means of deflecting gas bubbles from entering the outflow orifice; and at the same time, precludes larger gas bubbles entrained within the effluent from passing into the outflow orifice.

The invention contemplates therefore, a septic tank for use in a seweraged disposal system, that tank comprising walls defining:

(a) members defining a hollow plenum and an inflow wall and an outflow wall;

(b) a sewerage inflow orifice defined by the inflow wall and an outflow orifice defined by the outflow wall each orifice communicating with the hollow plenum;

(c) a pair of track means carried by the wall defining the outflow orifice and extending generally vertically from adjacent diametrically opposed margins of the outflow orifice and generally extending from an elevation generally above the outflow orifice to an elevation generally below the outflow orifice;

(d) a sheet member having two marginal edges and disposing a surface therebetween that is greater than the distance between said pair of track means each edge adapted to engage into one of said tracks, thereby to sealing separate the hollow plenum, into a minor outflow plenum defined by the sheet member and a segment of the tank wall adjacent thereto, the minor outflow plenum communicating with the outflow orifice at an elevation super adjacent from that communication of the minor outflow plenum with the balance of the plenum.

The invention also contemplates that the inflow and outflow orifices be at different elevations, with the outflow orifice at a lower elevation than the inflow orifice and that both inflow and outflow orifices be bound by a sheet member of like configuration of (d) aforesaid so as to partition the hollow plenum into inflow and outflow subplenums communicating with the main plenum.

Additionally, the invention contemplates an article of manufacture being a rigid sheet of non-corrosive material formed into a longitudinal curving extent and having two opposite longitudinal margins each disposing means for attaching and affixing the sheet into sealing engagement with a race of predetermined cross-sectional configuration. Particularly, the article of manufacture has longitudinal marginal tags which, in one embodiment, each tag has the cross-section of a "T" and, in another embodiment, the cross-section of a bifurcated fork.

Preferably the fork has two fingers and at the distal end of each an arrowhead which acts as a locking mechanism.

Additionally, in a further embodiment of the invention, the invention contemplates a longitudinal track defining a race, for use in a sewerage disposal system comprising:

(a) a longitudinally partitioned channel defined by a longitudinal base member being integral to opposite longitudinal margins disposing opposite sides so that the base and the opposite sides define a longitudinal race therebetween;

(b) the sides projecting forward a frontal margin defining a longitudinal crease and terminating in a flat frontal flange each of which has a respective longitudinal distal margin near the other than the space between the opposite sides so as to define between the distal margins of the frontal flange a frontal longitudinal gap;

(c) the inner surface of each side extends as an interiorly mounted flange toward the other side to define an inner marginal edge of each inner flange in proximaty closer to each other than to the interior distance between each side and hence to define an interior longitudinal gap that partition in the longitudinal direction the interior of the track into a forward plenum and a rearward plenum that communicate with each other through the interior longitudinal gap and with outside by the frontal longitudinal gap.

Specifically, the longitudinal track has a flexible flap made of plastic, particularly a vinyl, and the balance of the track is made of a rigid plastic like P.B.C. Specifically, in one embodiment, the interiorally mounted flanges are orthogonal to each of the sides and, in another embodiment, they are inclined relative to each side and depend toward the base.

The invention also contemplates a deflection member for use in a septic tank employing at least two channels each channel carrying a race therein, the deflection member comprising an essentially flat surface with anchoring means at one end of said surface, the said anchoring means adapted to engage in said race so as to dispose the flat surface at an inclined angle relative to the race.

This deflection member preferably has anchoring means in the cross-sectional configuration of a "T" by which it may be anchored to a T-rail or other means.

The invention will now be described by way of example and reference to the accompanying drawings in which:

FIG. 1 is a sectional elevational view of a septic tank according to the invention in situ; while

FIG. 2 is a partial perspective of the novel sheet according to FIG. 1;

Figure 4:
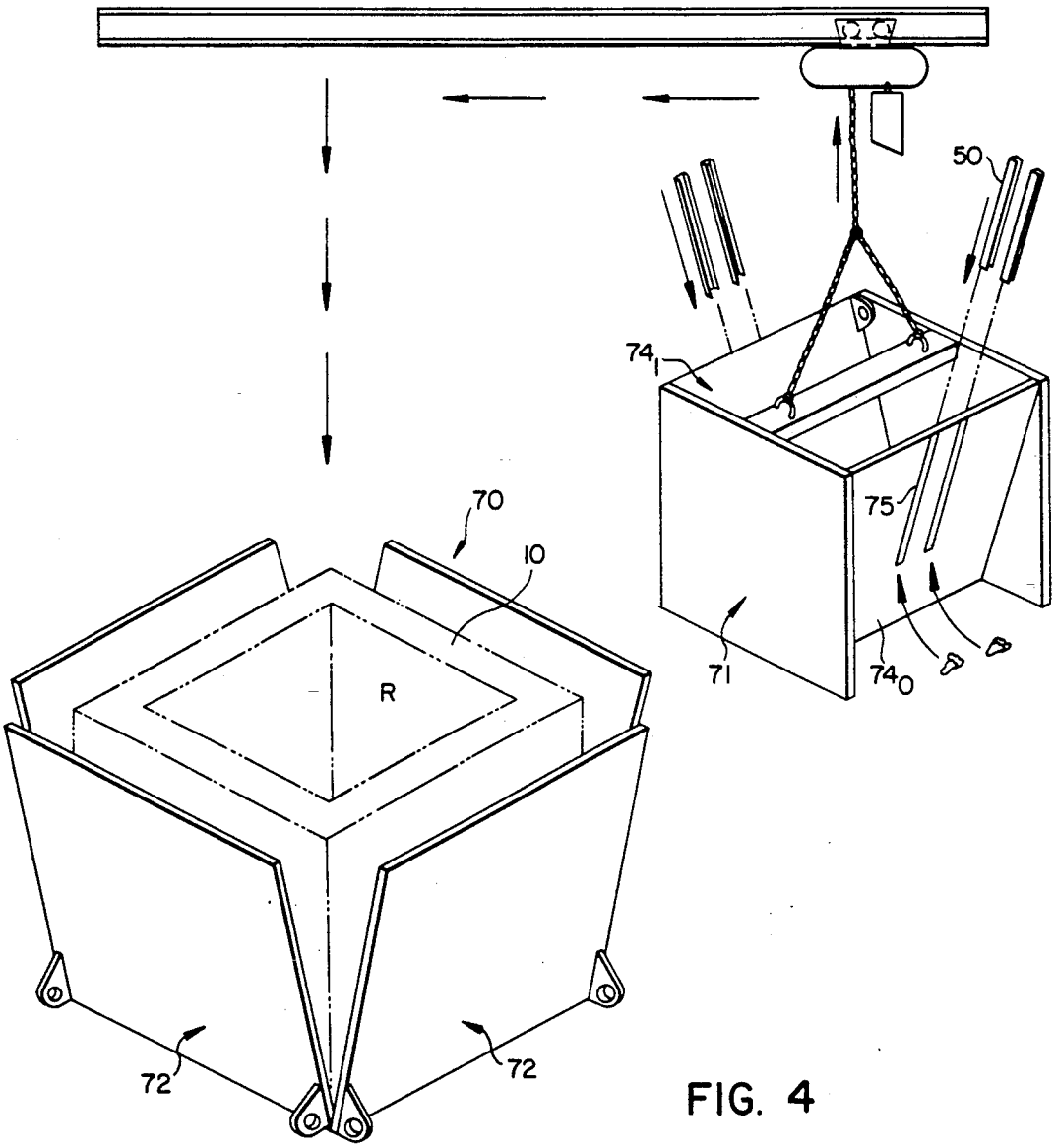
Figure 5:
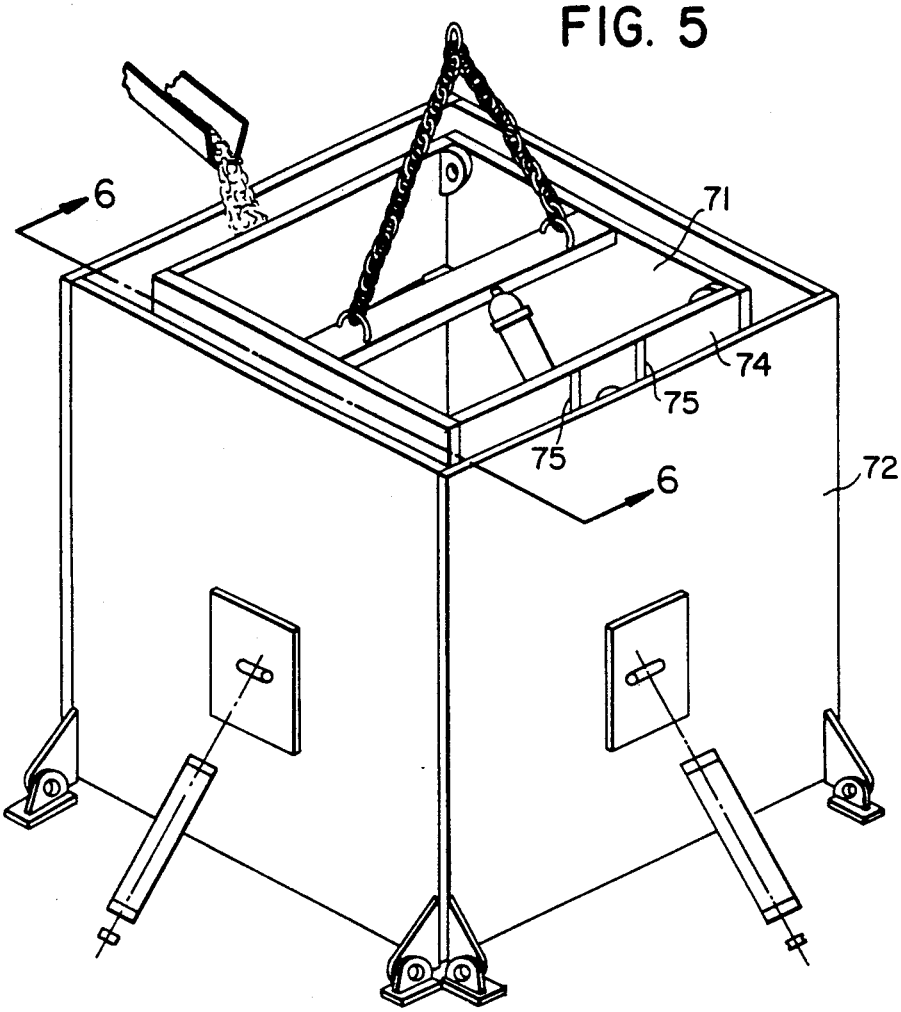

FIGS. 3A, 3B, and 3C are all views along section lines III—III of FIG. 2 showing the step construction and application of the bathal mounting according to the invention;

FIG. 4 is a perspective, of an initial molding face in the fabrication of a concrete septic tank that employs the novel linear barrier according to the invention;

FIG. 5 is an illustrative perspective view of the mold suitable for the manufacture of a concrete septic tank linear barrier according to the invention illustrating installation of baffles.

Figure 6:
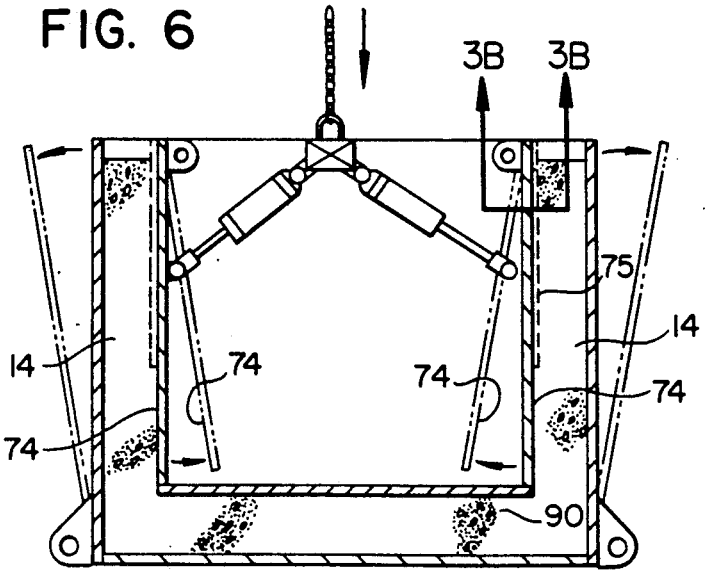

FIG. 6 is a section along VI—VI of FIG. 5

Figure 1:
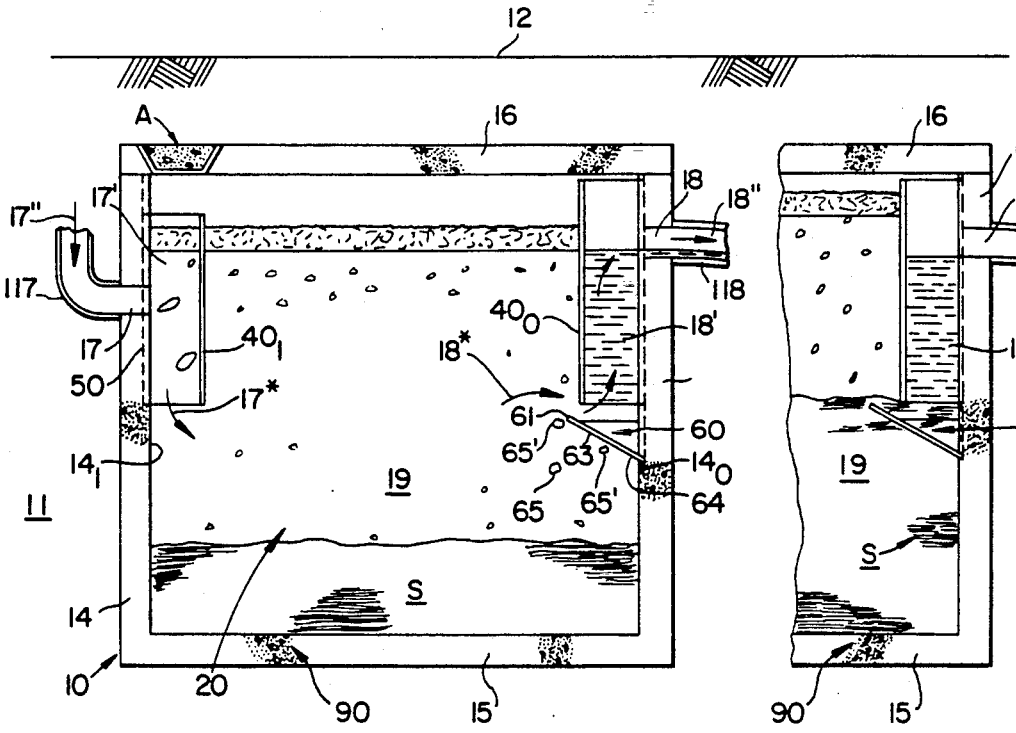
Figure 7:
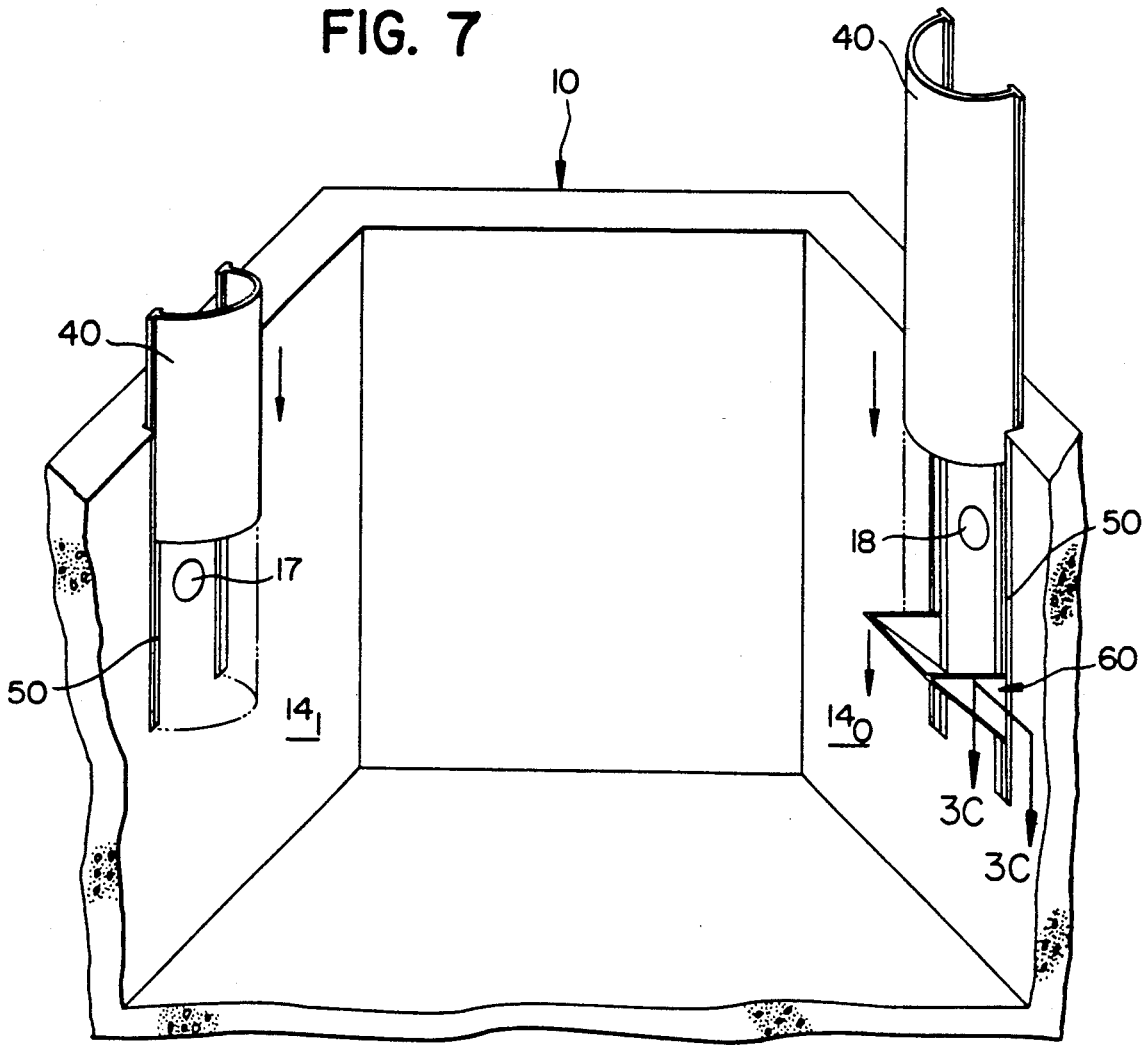

FIG. 7 is a partially broken away perspective view of the embodiment of FIG. 1.

Figure 8:
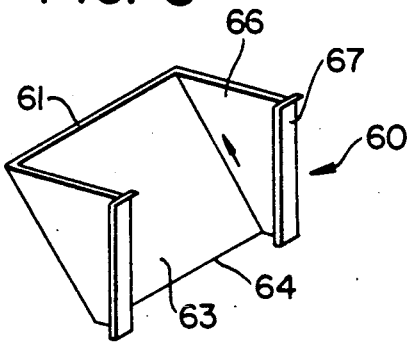

FIG. 8 is a perspective view of an embodiment of deflection plate.

Figure 9:
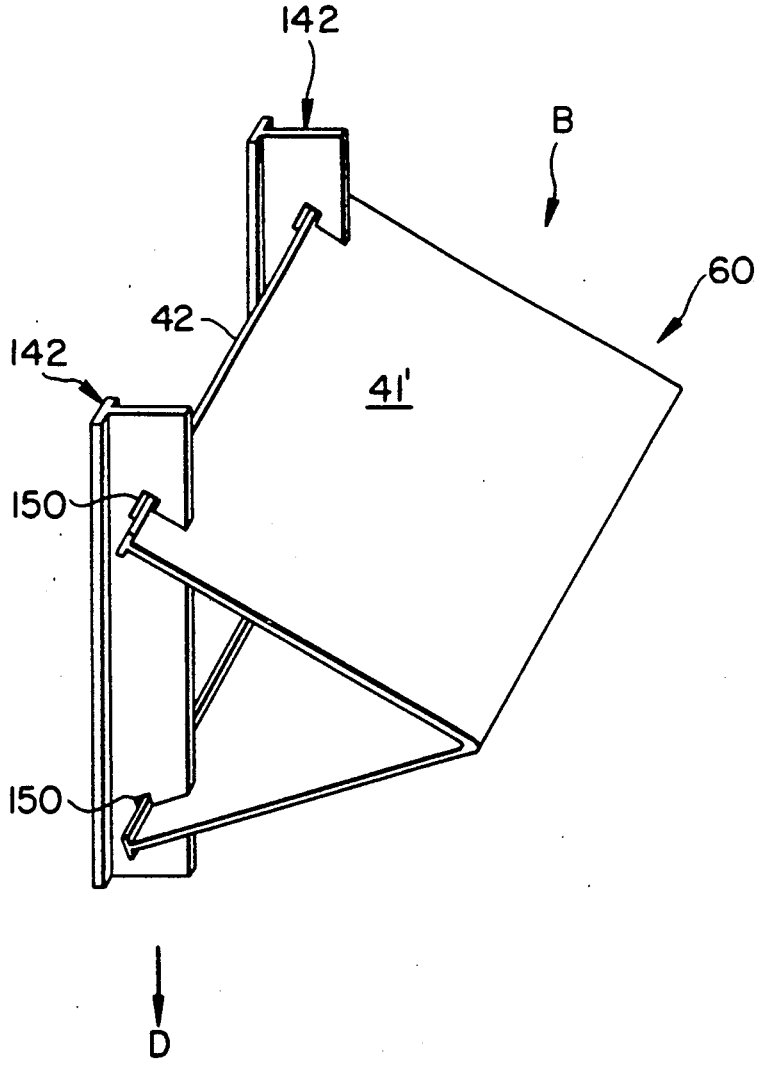

FIG. 9 is a perspective view of the preferred embodiment of deflection plate.

Figure 10:
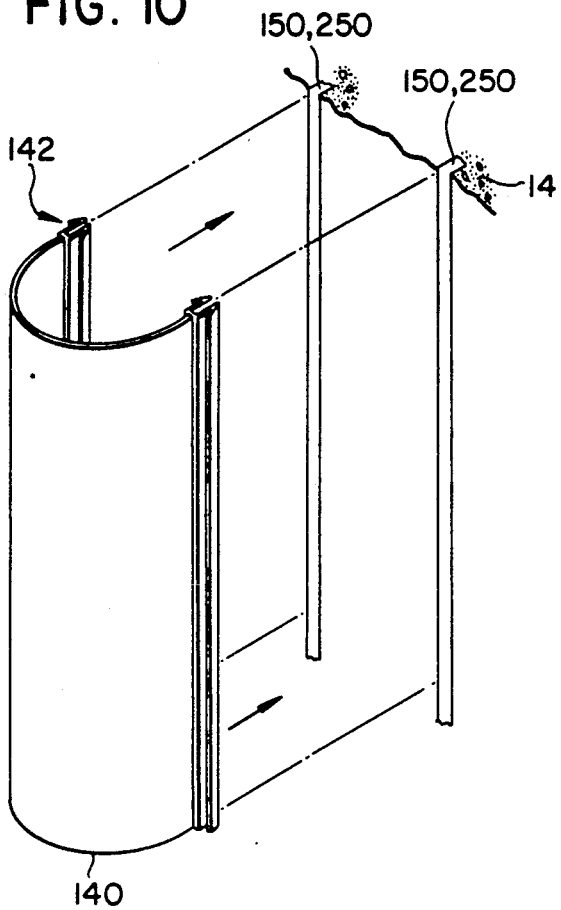

FIG. 10 is a perspective view of an alternative embodiment of the baffle and track and means on inserting and mating the same.

Figure 11:
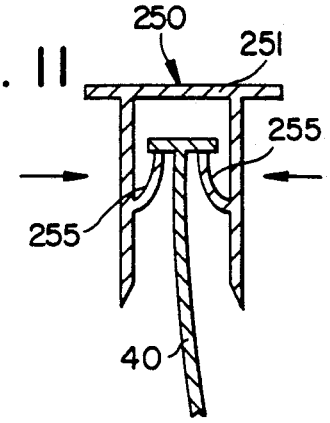
Figure 12:
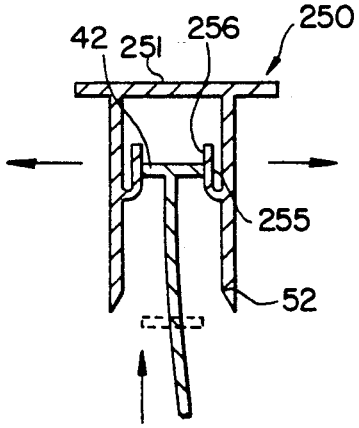

FIGS. 11 and 12 are cross-sections through an alternative embodiment of track capable of being used with baffle according to FIGS. 1 through 7 as earlier described.

Figure 13:
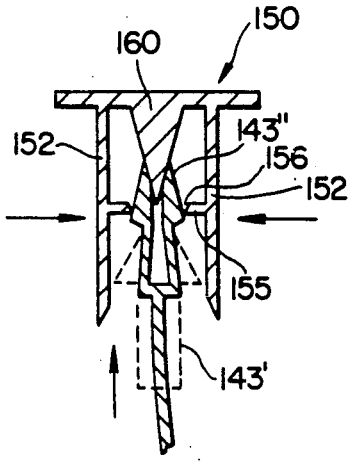
Figure 14:
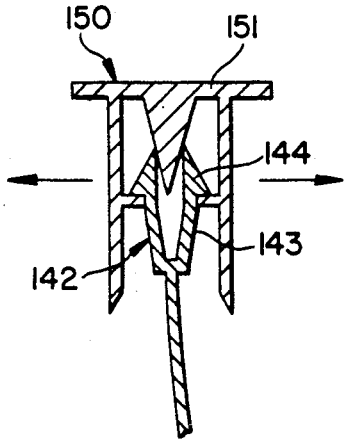

FIGS. 13 and 14 are respective alternative embodiments of track and of the tag element of the baffle showing alternative engagement and mating means for the baffle and track.

Referring to FIG. 1, a septic tank 10 is shown embeded in the surrounding ground 11 and below the ground surface 12. The tank 10 defines vertical walls 14, a bottom end 15 and an upper open end that is closes off with an upper slab 16. Generally the tank 10, and subsequently the slab 16, are separately fabricated from concrete or reinforced concrete. Referring to the tank 10, in one wall **14*i* an inflow orifice 17 is defined and in the other opposite wall 14*o* an outflow orifice 18 is defined. In the particular embodiment, although not necessary, the elevation of both inflow 17 and outflow 18 orifices are generally the same. In some applications it is desired that the inflow orifice 17 be at an elevation higher than that of the outflow orifice 18. In some applications it is possible to have the inflow and outflow orifices on opposite side walls near either end of the tank rather than on the end walls. It is not considered important for the purposes of this disclosure to show various specific locations of inflow and orifices 17 and 18, as these will generally be dictated by the application environment and regulatory authorities. Suffice it to say,wherever the inflow and outflow orifices are, and as will become apparent, in a preferred embodiment of the tank, a master and two subplenums will be formed according to the embodiments of the invention. In any event, it is the elevation of the outflow orifice 18 that will establish the total useable volume of the plenum 20 defined by the tank 10. The plenum 20, as will become apparent, is separated into at least two subplenums, and preferably three subplenums; namely a central larger or major plenum 19 wherein the majority of solids within the liquid sewerage exist and flow as they enter from the inflow orifice 17 into an inflow subplenum 17', that is part of the plenum 20 and communicates, therefore, with the major plenum 19**.

Referring to FIG. 1, the inflow minor plenum 17' therefore communicates, at its lower extremity, as shown by arrow 17*, with the major plenum 19 while in turn, likewise the major plenum 19 communicates with an outflow subplenum 18' via arrows 18* to the outflow orifice 18.

Referring to FIGS. 1 and 2, the inflow minor plenum 17' and the outflow minor plenum 18' are isolated relative to the major plenum 19, by a commonly constructed curved baffle, shown in FIGS. 2, 3, and 7, and generally illustrated as curved baffle 40. For the sake of clarity, the inflow baffle is indicated as $40_i$ while the outflow baffle is indicated as $40_O$.

Figure 1A:
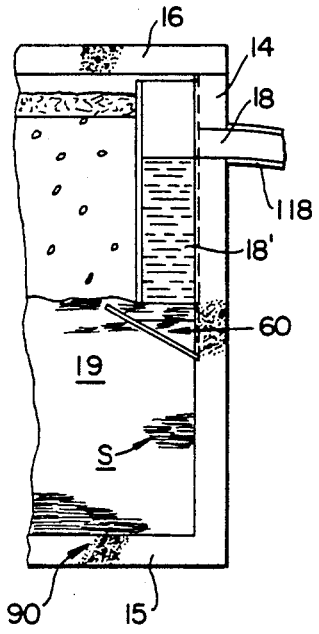
FIG. 1A is a partial view, in section, of the same septic tank with sod closing off the outflow channel.

Referring to FIG. 1A it is to be preferred, for the reasons as herein set forth, that below the lower extremity of the outflow baffle $40_o$ there be an inclined deflecting plate 60 whose upper inclined distal end 61 is at an elevation at or above the lower extremity of the outflow baffle $40_o$ and whose lower end 64 seals against the inner wall $14_o$. Referring to FIG. 1, as a necessary evolution of sewerage decomposition within the major plenum 19, is the decomposition of the sewerage into a liquid effluent (18*) and solids which congeal and precipitate to the bottom of the plenum 19 and thereby form a fermenting mass S. The fermenting mass S goes through a further decomposition process where effluent is released and also gas is formed in the mass S and bubbles 65 explode through the mass surface to rise. These gas bubbles should be effectively deflected by the deflection plate 60 away from the lower opening to the outflow baffle $40_o$ so that potentially explosive Hydrogen gases $H_2$ and the "rotten egg" smelling Sulphur Dioxide gases $HSO_2$ which constitutes the major components of the gases formed by the fermenting mass S are deflected from direct passage into the outflow plenum 18'. The deflection plate 60 ensures that these gases which boil out of the mass are deflected flowing into the lower channel of the outflow minor plenum 18' and hence do not flow into the outflow orifice 18 into the tile bed communicating pipe 118. In certain instances, the fermentation of the mass S is so strong that as the gas bubbles explode (not shown) from the surface of the mass they carry upward a significant volume of the solids of the mass with it. The deflection plate has the ability to shield these uprising solids from travelling into the minor plenum 18' and, hence, clogging the tile bed. Another advantage to the deflection plate 60, and now referring to FIG. 1A is that if the precipitating solid mass S accumulates in the plenum 19 to sufficient depth as to rise above the distal end 61 of the deflection plate (it being exaggerated in FIG. 1A) the solid mass closes off the lower extremity of the subplenum 18' and solids are prevented from going into tile bed communicating pipe 118 and clogging the tile bed. The tank will then have to be "pumped out" where regulatory authorities allow such pumping out or totally replaced without the need of replacing the tile bed.

Referring to FIGS. 2 and 3, the baffle 40 is made of a unitary sheet plastic material by extruding the same as a flat sheet with opposite marginal sides having tags of "T" shaped cross-section and while hot the same is formed into an arcuate sheet 41, as clearly seen in FIG. 4, and cut to an appropriate length so that the curved sheet has as lateral longitudinal distal margins in cross-section, "T"-shaped flange 42. Preferrably the arcuate sheet traces out a semi circle. The T-shaped lateral distal flange 42 acts as a "key" for indexing and sealing mating with the side walls 14 of the tank 10 by mating into a track or race 50 mounted in situ into the concrete interior walls 14 during the fabrication of the tank 10 in a manner as will be described.

Baffles 40, together with the key tracks 50 when positioned in situ within the tank 10, as will be described and generally shown in FIGS. 3 and 7, mate with each other to respectively form the inflow minor plenum 17', as well as the outflow minor plenum 18', the lower extremities of each communicating with the major plenum 19 and providing a clear flow pass from inflow orifice 17 to outflow orifice 18 as will be described for the sewerage into the tank and for effluent out of the tank.

The track 50 is a longitudinal partitioned channel having a flat base 51, integral with side walls 52, that along their midstream have inwardly projecting detents 55 which partition the inner portion of the channel into a rearward recess 56 communicating with a forward recess 57 through a central gap 56'. The distal ends of the side walls 52 fold toward each other as tag strips 53 through a breakaway joint 54 interjoining them to define a frontal slot 57'.

As will be apparent from FIGS. 3, the detents 55 which partition the channel into inner and outer regions or recesses 56 and 57 also define a central gap 56' small enough to allow the baffle 41 to extend therethrough but large enough to constrain the distal tag 42 of the baffle 40. The baffle 40 therefore is slipped down, into the race 50 as shown in FIG. 2 with the tag 42 being locked and constrained in the rearward recess 56 (the tag strips 53 having been removed after concrete curing as will become apparent and as will now be described).

Referring to FIG. 3 and particularly to FIGS. 3A, B, and C, the track 50 carries a flexible flap or vane 59 that is integrally molded onto the exterior surface of each of the exterior surfaces of the side walls 52 and as will be apparent in FIGS. 3B and C provides for a temporary sealing strip, during construction of the tank 10, to inhibit the flow of the tank fabricating material, fluid concrete, from flowing into the foreward and rearward recesses 57 and 56 during pouring. If this were to happen, the track 50 would be clogged with hardened concrete on curing; and hence, the track would be rendered useless for its intended use.

Referring to FIG. 4, the same shows a mold generally as 70 with an inner core 71 and an outer sleeve of four orthogonal surfaces 72, forming therebetween, a region R into which eventually fluid concrete is poured so that the cured and finished concrete septic tank 10 can be formed therein (the finished tank 10 being shown in phantom). In these figures, the components of the mold 71, 72 and 75 are shown as sheet steel so as to provide strength; however, other mold materials may be used.

On one of the outer surfaces 74 of the inner core 71 there is bolted or otherwise mounted, two rigid rails 75 in parallel spaced apart relationship and each act as temporary mounting rails or means for mounting one track 50 onto the core surface 74 so that each track 50 is integrally attached to that core surface 74. The tracks 50 extend into the region R of FIG. 4 prior to the pouring of the fluid concrete therein, for ultimate fabrication of the tank 10. The assembly of the core 71 with the outside (opposite) surrounding surfaces 72 is shown in FIG. 5. One of the inner core surfaces 74 may be the outflow inner surface $74_O$ of the tank 10 while the opposite surface 74 is the inflow inner surface $74_I$.

The rail 75, preferably, is an oblong in cross-section, longitudinal metal strip or similar piece with distal tips 76 located at a greater distance than proximate tips 77; the latter of which intermate with surface 74 as shown in FIG. 3B. The width of the proximate tips is smaller than the frontal gap 57' of the track 50, and the thickness T of the rail 75 is not as deep as the forward recess 57 of the track 50 while the distance between the distal tips 76 is greater than that of the frontal gap 57' but less than the internal lateral dimensions of the frontal race 57' between side walls 52. This is clearly shown in FIG. 3B. The rails 75 are biasingly urged against the inner surface 74 (see FIGS. 3B and 6) by means of a countersunk bolt 80 which extends through an aperture 81 in the core wall 71. The bolt has an end nut 84 or other means that provides a stop for a coil spring 85 helically mounted over and between the nut 84 and the wall 74 so as to biasingly urge the rail 75 against the inner wall 74. As such the rail 75 "holds" the track 50 with the distal tags 53 urging against the surface 74 and the flexible flap 59 urging against the surface 74, as shown in the FIG. 3B, the later forming a fluid sealing margin with the surface 74.

Referring to FIG. 4, a pair of parallel rails 75 are therefore mounted onto the surfaces $74_O$ and $74_I$ in the manner shown; and for convenience, the surfaces $74_O$ and $74_I$ are part of a movable central core. The track 50 in the configuration of FIG. 3A is slipped over and onto each of the rails 75 in a manner shown by the arrow 50' in FIG. 4. Because the rails 75 are sized and have the cross-sectional configuration shown and described with reference to FIG. 3B, the rails 75 hold the track 50 so that the flap 59 urges, as seen in FIG. 3, against the core surface 74 ($74_O$ or $74_I$) and provides a liquid or fluid tight seal at that juxtaposition of the core surface 74 with the flap 59 so that during pouring of fluid concrete into the region R the fluid concrete will not flow past the distal ends of the side walls 52 and into the channel 50 and occupy either the forward or rearward recesses 56 and 57. (It is after construction of the tank 10 that the channel or track 50 assumes the configuration of FIG. 3C when it is fixedly imbedded in the cured solid concrete 90). When pouring is complete and the concrete has primarily cured, referring to FIGS. 5 and 6 for example, the inner core is pulled inward in accordance with the arrow shown in FIG. 6 and the rail 75 ripped away from the track 50 pulling with the tag strips 53 shown as 53' in FIG. 3B. (The figure is not quite accurate because the wall 74 is shown mounted between the broken away tag strips 53' and the integrally associated tag strips 53.) In any event, when the rails 75 are pulled away from the track, which is imbedded in the concrete, the cross-sectional configuration of the track in the concrete assumes that of FIG. 3C.

Referring to FIGS. 2 and 3 the baffle 40 is a curved sheet 41, as shown so that in cross-section it is essentially hemispherical. Each of the longitudinal marginal edges 42 of the sheet 41, terminate into a flanged butt on tag 43 that is wider than the rearward gap 56' but narrower than width of the rear recess 56 in a manner as clearly seen in FIGS. 3A and 3B. The tag 43 has "T" shaped cross-sections. The thickness of the curved sheet 41 is narrower than the rearward gap 56' and this accommodates the passing therethrough of the baffle sheet surface 41 and the flanged butts or tags 43 hold the baffle in the track.

The poured concrete tank is removed from the core as earlier described with reference to FIGS. 5 and 6; and thereupon, it is appropriate to install the baffle 40, since the tracks 50 extend from the upper end of the walls 14 toward the bottom but do not touch the bottom, see FIG. 1, the curved baffle sheet may be slid, and referring to FIG. 2, into the channel or tracks 50 following arrow 39 of FIG. 2 prior to the slab 16 being placed on top.

A pair of such baffles 40 is preferably provided one $40_I$ for defining the inflow minor plenum 17' and the other baffle $40_O$ for defining the outflow plenum 18'.

In an additional embodiment of the invention, an inclined deflection plate generally indicated as 60 (see FIGS. 1, 1A, 7, 8, and 9) is provided at the bottom of the outflow baffle $40_O$. It may consist of an inclined flat sheet 61 with distal end 61 disposed at an elevation preferably slightly above the lower extremity of minor outlow plenum 18' while disposing a lower inclined flat surface 63 and a proximate lower end 64 in juxtaposition with the inner side wall 14. Gas bubbles are generally indicated as 65 and may consist of either Hydrogen gas or Hydrogen Dioxide gas. During their upward migration in plenum 19 they are deflected by the inclined surface 63 away from the bottom of baffle $40_O$ so that the effluents flowing out of plenum 19 according arrows indicated as 18* will not carry with them these entrained gases, and more importantly, solids S which the gas bubbles 65 may carry with them. In this way the entrained gases (and solids S) are withheld from flowing out into the tile bed pipe 118, thereby avoiding, on the one hand, the smell of rotten eggs and on the second hand, the accumulation of Hydrogen gas which if mixed with Oxygen would be highly combustible and dangerous and on the third hand flows and subsequent accumulation of solids S in the tile bed.

Referring to FIG. 8 and the deflection plate 60, the same consists of an upper distal edge 61 which transverses into an inclined sheet 63 and terminates at a lower distal edge or margin 64. Vertical sides 66 constrain the sheet 63 in the inclined position and a trag 67 of T shaped cross-section relative to the sides 66 completes the deflection plate 60. The spacing of the trag 67 one from the other is such as to allow the deflection plate 60 to be slid into the parallel tracks 50 of FIG. 7 prior to the sliding of the baffle 40 in the surface $14_o$.

An alternative form of deflection plate 60 is shown in FIG. 9 and encompasses the same sheet material extruded for the baffle 40; but rather than configured into a cross-sectional profile of a semi-circle, the same is configured into the cross-sectional profile of a wedge shown as 41' or B in FIG. 9. Tracks 142 are extruded, (conveniently from the same extruder that makes the T cross-section for the baffle 40) but with excess material severed away. In the base of the "T" cross-section "T" notches 150 are cut by appropriate means which allow the tab 42 of the wedge 41' to be inserted therein. The deflection plate B therefore can be slipped in parallel tracks 50 on the outflow inner surface $14_o$ in lieu and instead of that deflection plate shown in FIG. 7. This preferred deflection plate B of FIG. 9 employs the same extrusion equipment as that for the baffle 40 and when the T lengths 142 are made the excess material may be put back into the mix for extrusion again at a later date in making either the curved baffle 40 or the baffle B (41' of FIG. 9).

In some applications it may be desirable that rather than "sliding" the baffle 40 or the deflection plate 60 into the track that the track have the ability so the tab 42 of the baffle 40 can be "pushed" into a modified 50 illustrated in FIG. 10 as track 250. The specific profile of the track 250 may be that of FIG. 11 or 12 in one embodiment or 13 or 14 in another.

In FIG. 10 a modified baffle 40 according to the invention is shown as 140 with bifurcated tags 142 as shown in FIGS. 13 and 14. The bifurcated tags 142 of FIGS. 13 and 14 consist of a pair of fork members 143 spaced appart with arrowheads 144 mounted at the distal ends thereof. The track 50 is modified into the form 150 wherein the base 151 provides a central uprising longitudinal member 160 that preferrably come in cross-section, is that of an arrow projecting toward the inner channel gap 156 formed by the opposite orthogonally inwardly projecting detents 155 surmounting the side walls 152. Referring to FIG. 13 in the phantom position, the bifurcated tab 143 is moved from the phantom position of 143' into the home position 143" where the tip of the arrow engages between the bifurcated tips 142 spreading them apart. The base of the arrowhead 143 having been pushed through the longitudinal gap 156 seats against the inside surface of each detent 155 all as shown clearly in FIG. 14. The configuration therefore of the channel 150 is virtually identical to that earlier shown and described save and except as to the integral molding of the base uprising member 160 which in the preferred embodiment has the cross-section of an arrow, as shown in FIGS. 13 and 14, but as well could be any other appropriate confirguration.

Referring to FIGS. 11 and 12, and also FIG. 3A, rather than the inwardly depending detents 155 projecting orthogonally toward the center to form the intergal gap 56' or 156' the detents maybe formed as a pair of inclined detents 255 inclined towards the center of the base 251, in the manner as shown in FIGS. 11 annd 12. The baffle 40 with the straight tabs 42 of FIGS. 2 and 3 may be used. Referring to FIG. 12, the tab 40 is pushed into the gap 256 defined by the distal margins of inclined detents 255 and these detents flex into the position of FIG. 12 and move toward the channel walls 252 inaccordance with the opposite arrows illustrated in that FIG. 12. On further pushing, inaccordance with the single arrow of FIG. 12, the tab 42 passes through the enlarged gap 256 past the distal end of the inclined detents 255 which "snap back", and now referring to FIG. 11 in the direction of the opposite arrows of that figure to engage against the inner surface of the "T" tag 42 and through thereby hold the baffle in FIG. 11 and to constrain the baffle in a manner similar to that described in relation to the embodiment of FIGS. 1 through 7. The advantage of the embodiment of FIGS. 10 through 14 eliminates the needs for "sliding" the baffle down the track and hence allows "servicing" of the baffles in applications where the cap has a manhole allowing a person to enter into the tank when in service to remove and replace a baffle so as to clean out either inflow or outflow orifice as the case might be.

The embodiments of the invention in which an exclusive property or privilege is claimed are defined as follows:

1. A longitudinal track defining a race, for use in a sewerage disposal system comprising:

(a) a longitudinally partitioned channel defined by a longitudinal base member being integral to opposite longitudinal margins disposing opposite sides so that the base and the opposite sides define a longitudinal race therebetween;

(b) each side projecting forward to a frontal margin defining a longitudinal crease and terminating in a flat traversely oriented frontal flange with flange each having a respective longitudinal distal margin in relatively closer proximity defining a frontal narrow longitudinal gap therebetween;

(c) the inner surface of each side extends as an interiorly mounted flange toward the other side to define an inner marginal edge of each inner flange in proximaty closer to each other than to the interior distance between each side and hence to define an interior longitudinal gap that partition in the longitudinal direction the interior of the track into a forward plenum and a rearward plenum that communicate with each other through the interior longitudinal gap and with outside by the frontal longitudinal gap.

2. The track as claimed in claim 1 wherein the channel wall thickness at the crease is less than the thickness of the sides so that the frontal flanges are easily removed.

3. The track as claimed in claim 2 having mounted, near the crease, but on the outside surface of each of the sides, a flexible lip which curvingly extends forward and beyond the frontal surface of the frontal gap.

4. The track as claimed in claim 3 wherein the flexible flap is made of flexible plastic while the balance of the track is made of rigid plastic.

5. The track as claimed in claim 3 wherein the flexible flap is made of flexible plastic is a vinyl while the balance of the track is made of rigid plastic which is P.V.C.

6. The track as claimed in claim 3 wherein the flexible flap is made of flexible plastic while the balance of the track is made of rigid plastic and the anchoring means is a longitudinally extending flange mounted on the exterior of the opposite sides.

7. The track as claimed in claim 2 where the longitudinal base member has a V shape protrusion, protruding toward the frontal margin so that its apex is disposed immediately behind a plane defined by the interiorly mounted flanges and said interior longitudinal gap.

8. The track as claimed in claim 1 including means mounted on the exterior surface of the track adapted for anchoring the track in surrounding material.

9. The track as claimed in claim 1 where the longitudinal base member has a V shape protrusion, protruding toward the frontal margin so that its apex is disposed immediately behind a plane defined by the interiorly mounted flanges and said interior longitudinal gap.

10. The track as claimed in claim 1 wherein the each of the interiorly mounted flanges integral with the side is orthogonal to the side and the side is orthogonal to the base.

11. The longitudinal track as claimed claim 1 wherein each of the interiorly mounted flanges are inclined relative to the side, depending toward the base.

* * * * *